US011413781B2

(12) United States Patent
Baum et al.

(10) Patent No.: US 11,413,781 B2
(45) Date of Patent: Aug. 16, 2022

(54) GRIPPER

(71) Applicant: Weber Maschinenbau GmbH Breidenbach, Breidenbach (DE)

(72) Inventors: Dennis Baum, Eschenburg (DE); Fabian Jung-Sassmannshausen, Bad Endbach (DE); Thorsten Schneider, Weimar/Lahn (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 0 days.

(21) Appl. No.: 16/186,526

(22) Filed: Nov. 10, 2018

(65) Prior Publication Data

US 2019/0143552 A1 May 16, 2019

(30) Foreign Application Priority Data

Nov. 10, 2017 (DE) ..... 102017126377.2

(51) Int. Cl.
*B26D 7/01* (2006.01)

(52) U.S. Cl.
CPC ..... *B26D 7/018* (2013.01); *B26D 2007/011* (2013.01); *B26D 2210/02* (2013.01)

(58) Field of Classification Search
CPC ..... B26D 7/018; B26D 7/1863; B26D 7/01; B26D 2210/02; B26D 2007/011; B25J 11/0045; B25J 15/0675; B25B 11/005
USPC ..... 83/409, 100; 414/751.1–752.1; 269/20–22, 43
See application file for complete search history.

(56) References Cited

U.S. PATENT DOCUMENTS 3,880,295 A * 4/1975 Wyslotsky ..... B25B 11/005 414/18
4,750,768 A * 6/1988 Kumar ..... B66C 1/0212 294/185
8,678,776 B2 * 3/2014 Medow ..... B25J 15/0625 417/53
2010/0050833 A1 * 3/2010 Reifenhauser ..... B26D 7/018 83/13
2010/0050834 A1 * 3/2010 Reifenhauser ..... B26D 7/018 83/13

(Continued)

FOREIGN PATENT DOCUMENTS

CN 100403868 C * 7/2008 ..... H05K 13/0409
DE 10050713 A1 4/2002

(Continued)

OTHER PUBLICATIONS

German Search Report for German Application No. 10 2017 126 377.2 dated Oct. 31, 2018, 2 pages.

(Continued)

*Primary Examiner* — Nhat Chieu Q Do
(74) *Attorney, Agent, or Firm* — Dickinson Wright PLLC

(57) ABSTRACT

The present invention relates to a cutting apparatus having a gripper for gripping a product, in particular a food product, having a gripper base, and having a gripper head fastened to the gripper base, wherein the gripper head comprises at least one suction device that can be acted on by vacuum and that can be brought into contact with a section, in particular an end section, of the product to suck it in, with the gripper head being releasably fastened to the gripper base.

4 Claims, 7 Drawing Sheets

(56) References Cited

U.S. PATENT DOCUMENTS

| | | | | |
|---|---|---|---|---|
| 2010/0050835 | A1* | 3/2010 | Reifenhauser | B25B 11/005 83/13 |
| 2012/0032461 | A1* | 2/2012 | Hukelmann | B26D 7/018 294/183 |
| 2016/0271805 | A1* | 9/2016 | Kuolt | F04D 25/06 |
| 2016/0339597 | A1* | 11/2016 | Lischinski | B26D 1/25 |
| 2018/0186011 | A1* | 7/2018 | Pryor | B25J 11/0045 |
| 2018/0222074 | A1* | 8/2018 | Baumeister | B26D 7/018 |
| 2018/0369996 | A1* | 12/2018 | Meyer | B25B 11/005 |
| 2019/0061194 | A1* | 2/2019 | King | B26D 3/28 |

FOREIGN PATENT DOCUMENTS

| | | | | |
|---|---|---|---|---|
| DE | 102008011985 | B3 * | 7/2009 | B26D 7/018 |
| DE | 102011012880 | A1 | 4/2012 | |
| DE | 102011083498 | B4 | 8/2014 | |
| DE | 102014110569 | A1 | 1/2016 | |
| EP | 102008011980 | B3 | 7/2009 | |
| EP | 102008011985 | B3 | 7/2009 | |
| EP | 102008011979 | A1 | 9/2009 | |
| WO | 2012041491 | A1 | 4/2012 | |
| WO | WO-2012041491 | A1 * | 4/2012 | B26D 7/018 |
| WO | 2015169788 | A1 | 11/2015 | |

OTHER PUBLICATIONS

European Search Report for European Patent Application No. 18204712.6 dated Apr. 1, 2019, 2 pages.

* cited by examiner

GRIPPER

CROSS-REFERENCES TO RELATED APPLICATIONS

This patent application claims the priority of German Application No. 102017126377.2, filed Nov. 10, 2017, each of which are incorporated herein by reference in their entirety.

The present invention relates to a cutting apparatus for cutting food products, in particular to a high performance slicer.

Figure 12:
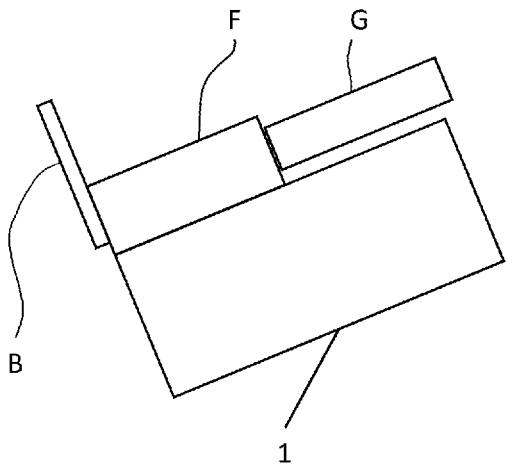

FIG. 12 illustrates a cutting apparatus 1 having a gripper G that engages a food product F for cutting with a blade B. Such apparatus in many cases comprise a gripper for gripping the food product. When cutting the product, rotating circular blades and scythe-like blades are used that correspond to a cutting edge as the termination of the supply region. The food product is here as a rule placed into a feed device that makes it possible to supply the product to a cutting plane in a clearly defined manner. In addition, an end section of the product is gripped and reliably held by the gripper. The product is 15 substantially transported toward the cutting plane by the feed device during the cutting process. However, the closer the cutting plane comes to the end section of the food, the more difficult it becomes to ensure the feed of the product and its positionally accurate fixing solely by the feed device. Significant transverse forces that have to be reliably compensated namely act on the product to be cut in the 20 cutting process. These transverse forces above all depend on the resistance of the product to the penetration of the cutting blade.

A transport belt is typically used that in particular ensures a reliable feed of the product and its fixing when the area of the product lying on the belt is as large as possible. This area becomes smaller and smaller toward the end of the cutting process so that the fixing of the product by the gripper becomes more and more important. On the one hand, it must ensure that the product is reliably transported toward the cutting plane. On the other hand, it must ensure that the product is held securely and—depending on the application—is also retracted for a portion preparation with short cutting interruptions.

Mechanical grippers are known that provide a fixing of the product by means of claws penetrating into the product. To ensure a sufficiently good fixing, however, they have to penetrate comparatively deeply into the product. This in turn means that a comparatively large end portion of the product can likewise not be cut, which has the consequence of correspondingly large waste. A utilization of the end section is also only possible with restrictions because the claws leave their traces in the end section.

Grippers are generally known in which a product is sucked in by means of vacuum and is thereby held. However, not all products can be held with the reliability required for high performance cutting machines by such grippers. High performance cutting machines having such grippers therefore particularly have a limited area of use in the field of food technology.

The area of "slicing foods" was described above purely by way of example as a possible area of use. It is, however, understood that comparable problems can also occur in other areas.

It is an object of the present invention to provide a gripper which can be used flexibly, which is compact, and with which a product can be reliably held.

The above-described object is satisfied by a gripper in accordance with claim 1.

In accordance with the invention, the gripper comprises a gripper base and a gripper head fastened to the gripper base. The gripper head has at least one suction device that can be acted on by a vacuum and that can be brought into contact with a section, in particular with an end section, of a product to suck it in, The gripper head is releasably fastened to the gripper base here.

This enables a fast and complication-free replacement of the head if it is defective or has to be serviced/cleaned or if a gripper head having different properties is to be used.

Further embodiments of the invention are set forth in the description, in the dependent claims and in the enclosed drawings.

A respective interface can be provided at the gripper head and at the gripper base for coupling the gripper head and the gripper base, said interfaces enabling a simple coupling of the two components. In accordance with an embodiment, the two interfaces each have a coupling section and a drive coupling section. The coupling section, that is preferably mechanical, serves for the fastening of the gripper head to the gripper base, while the drive coupling section serves for the transmission of operating media (e.g. hydraulic fluid, compressed air, . . . ) and/or of drive energy (e.g. current, torque, . . . ) that are/is required for the operation of the gripper, that is in particular of the suction device.

The drive coupling section preferably comprises at least one pneumatic coupling section, preferably at least two pneumatic coupling sections, and in particular exactly two pneumatic coupling sections. It is particularly advantageous if the interfaces are standardized so that different gripper head types can be quickly and simply connected to the base. Mechanical gripers, that are frequently pneumatically operated and that have two compressed air connections for this purpose as a rule, can then, for example, also be connected without problem if this is respectively required in the present application. A "mixed operation", i.e. a simultaneous use of different gripper types (e.g. of vacuum grippers and mechanical grippers) in a cutting apparatus, is likewise conceivable.

In accordance with an embodiment, the vacuum generation device for generating the vacuum by which the suction device can be acted on is arranged in or at the gripper head. The above-described embodiment of the gripper in accordance with the invention enables a compact manner of construction. The integration of the vacuum generation device in the gripper head makes it superfluous to supply vacuum to the gripper since said vacuum is generated there very locally. The gripper can thereby also be used in apparatus (e.g. high performance slicers) that only have the typically provided connections, that is no vacuum line of their own.

The vacuum generation device can in particular be operated by means of compressed air provided by a pneumatic system. It is, however, also conceivable to generate the required vacuum in another manner, for example by an electric vacuum pump.

In accordance with an efficient and inexpensive embodiment, the vacuum generation device comprises a jet pump, in particular an ejector. The vacuum generation device can have a chamber that is in communication with the suction device via a vacuum line and in which a nozzle device is arranged that can be flowed through by compressed air in operation of the vacuum generation device. The chamber has an outlet opening here that is formed in a releasable closure element. In other words, the closure element closes an opening of the chamber. However, it does not close it completely since an outlet opening is provided. Compressed air can escape therethrough that has flowed through the nozzle device to generate the vacuum.

The closure element can be connected, preferably releasably, to the nozzle device. The closure element preferably has a threaded section (e.g. an internal thread), for example, that cooperates with a complementary threaded section (e.g. an external thread) at the nozzle device. The closure element can have a further threaded section (e.g. an external thread) by which it can be fastened to the vacuum generation device. Suitable snap-in connections can likewise be used. The concept described above by way of example makes it possible that the nozzle device is first fastened to the closure element and the unit thereby produced is subsequently inserted into the chamber and is fixed there. This unit can then also thus be pulled out of the chamber again in a simple manner. Alternative fixing possibilities are likewise conceivable.

The pneumatic system can comprise a first pressure line that is connected to the vacuum generation device and that has a pressure regulator, in particular a proportional regulator, by which a supply of the vacuum generation device with compressed air can be regulated according to requirements. For example, the generated vacuum is monitored and on a deviation of the determined ACTUAL vacuum from the respectively wanted DESIRED vacuum, the compressed air supply is adapted by means of a corresponding control of the pressure regulator.

In accordance with an embodiment, the pneumatic system comprises a second pressure line connected to a suction unit of the suction device A pressure sensor that enables the monitoring of the respective vacuum present in the suction device or in its suction unit can be associated with the second pressure line.

The second pressure line can comprise a stop valve that is in particular configured as a controlled check valve. The stop valve can be switchable in dependence on a pressure that is present in the second pressure line. The valve is preferably configured such that it can be switched by the pressure that is itself present in the line. Provision can, for example, be made that it opens automatically on an exceeding of a threshold value of the pressure present in the line.

Provision can be made that the second pressure line and the chamber of the vacuum generation device are connected to one another via a bypass connection.

In accordance with an embodiment, the pressure sensor and/or the stop valve is arranged in or at the gripper base. The pressure regulator can also be arranged there. It can admittedly be advantageous in some cases to arrange these components in the gripper head. The association of these components with the base or even with the apparatus that is equipped with the gripper, however, enables a less expensive configuration of the gripper head.

The suction device can have at least one suction unit having a product contact surface, having at least one suction section, and having a sealing section arranged radially outside the suction section and surrounding the suction section. The suction device in particular has a distributor section to which the suction unit is releasably fastened and which is connected to the vacuum generation device by means of at least one vacuum line. The vacuum line is also in communication with the suction unit. The distributor section in particular has a plurality of vacuum passages and/or openings that are in communication with the suction unit. Provision can also be made that the distributor section has passages that are separate from the at least one vacuum line and that can be acted on by compressed air as required, for example to assist a release of the product from the gripper head and/or to flush the suction unit or other components. A releasable configuration of the distributor section enables its simple replacement if, for example, an adaptation of the distribution pattern of the vacuum is desired to optimize the suction properties of the suction unit. The same applies to the suction unit; it can also thus be replaced in a simple manner, e.g. for cleaning purposes or to be able to take account of the properties of the product to be sucked in.

The vacuum generation device can be fastened, in particular releasably, to the suction device, in particular to the distributor section. An integration in the suction device is also possible to achieve a particularly compact manner of construction.

The sealing section can comprise an elastic sealing device. For example, at least one bead and/or at least one sealing lip and/or at least one blade that at least penetrates sectionally into the product on a sucking in can be provided. Said sealing devices can also be combined with one another in any desired manner to achieve a reliable seal and thus a reliable holding of the product.

The suction unit can comprise a plurality of suction sections as required that are separated from one another spatially and/or by a sealing device. A separate application of vacuum to the suction sections can likewise be provided if this should be necessary to be able to apply a sufficiently good suction force in line with requirements. A local adaptability of the suction force can thus likewise be implemented.

In accordance with an embodiment, at least one pressure reservoir is provided that is integrated into the gripper head. It, for example, forms a structurally bearing part or section of the gripper head. The pressure reservoir can, however, also be a separate component that is installable at the gripper head (e.g. a cartridge or a reservoir cylinder) to functionally integrate it.

The pressure reservoir is at least connected to a functional device of the gripper head. The above-described vacuum generation device can be such a functional device. It is additionally and alternatively possible that the pressure reservoir is connected to components that are provided for an expulsion of the product or for a flushing of the system, e.g. nozzles acting on the product directly with the pressurized medium—as a rule a gas/gas mixture, such as air, for instance—and/or by elements actuated by the medium such as plungers, for instance.

The pressure reservoir so-to-say forms a "store" of "operating medium" close to the point of consumption, whereby e.g. the expulsion devices can be acted on by pressure over a longer time period, more strongly, and faster. The spatial proximity and the therefore comparatively short passages enable the output of pressure pulses that can be defined more sharply, which has an advantageous effect on the operating dynamics.

The pressure reservoir can be in communication with an external compressed air source constantly or in line with requirements. It is conceivable in particular to fill the reservoir on a loading of the cutting apparatus with the product to be cut.

A plurality of pressure reservoirs can also be provided that are associated with the individual functional devices of the gripper head. Depending on the application profile and/or on the available construction space, the reservoirs and the lines respectively functionally associated with them for actuating the corresponding functional device can form separate functional segments. The reservoirs can, however, also be connected to one another in parallel and/or in series.

The present invention further relates to an apparatus or to a system for cutting a product, in particular to a high performance slice for food products, having at least one gripper in accordance with any one of the above-described embodiments.

Figure 1:
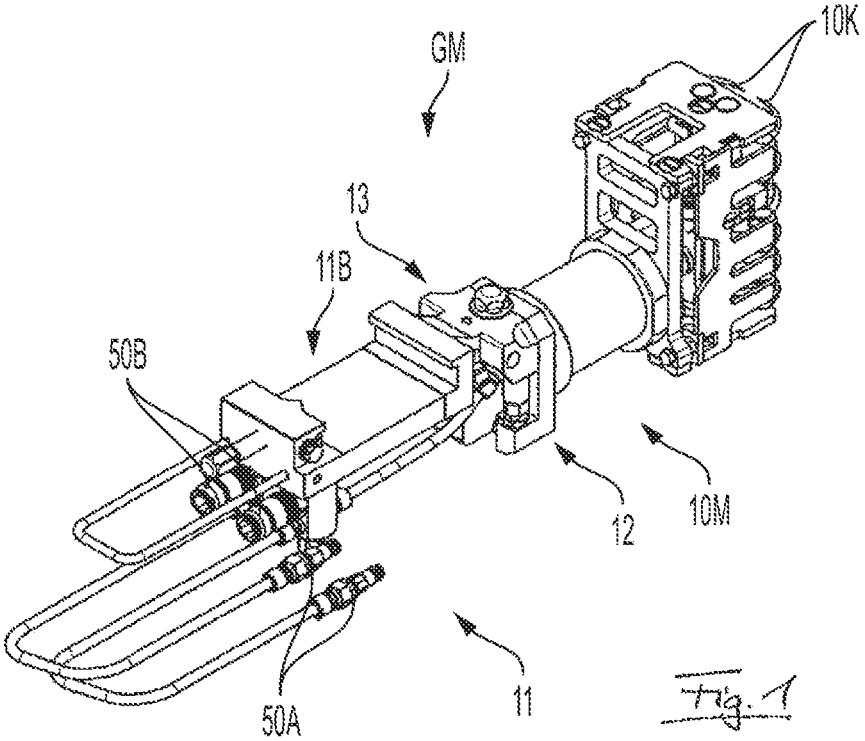
Figure 2:
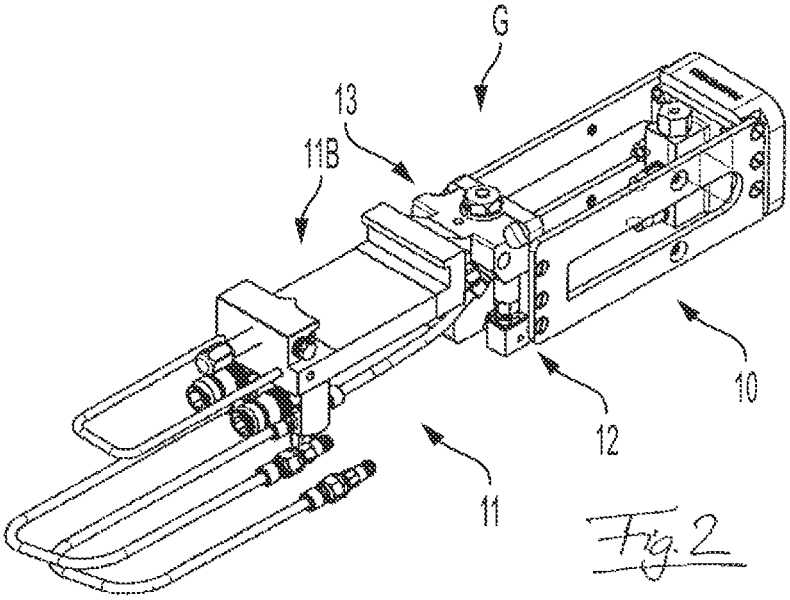
Figure 3:
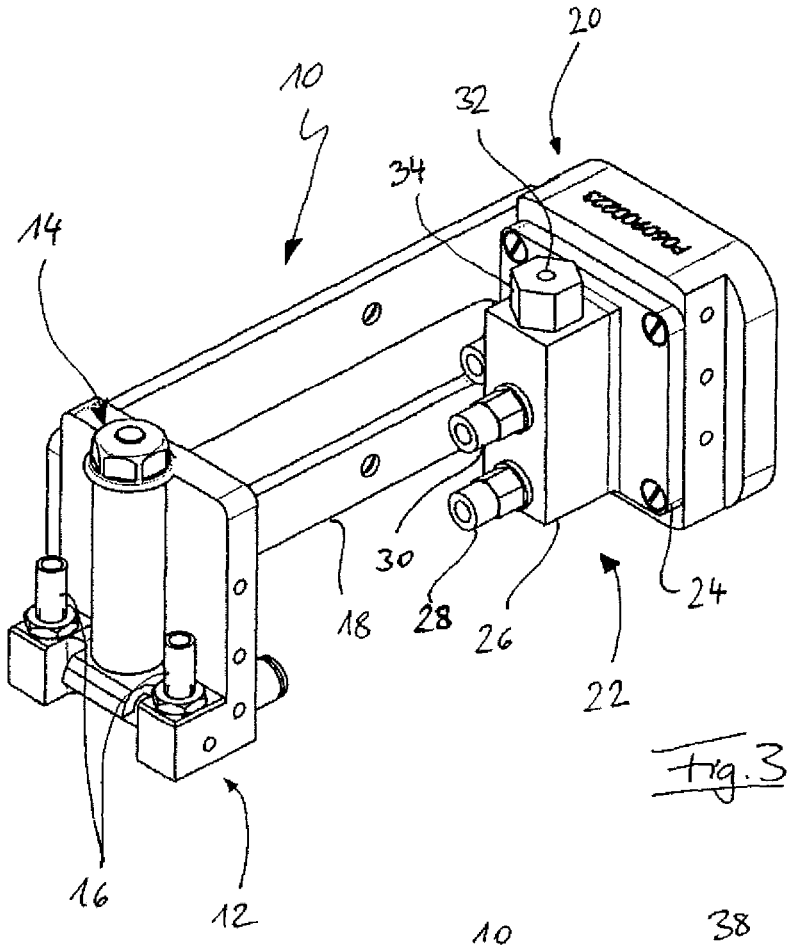
Figure 4:
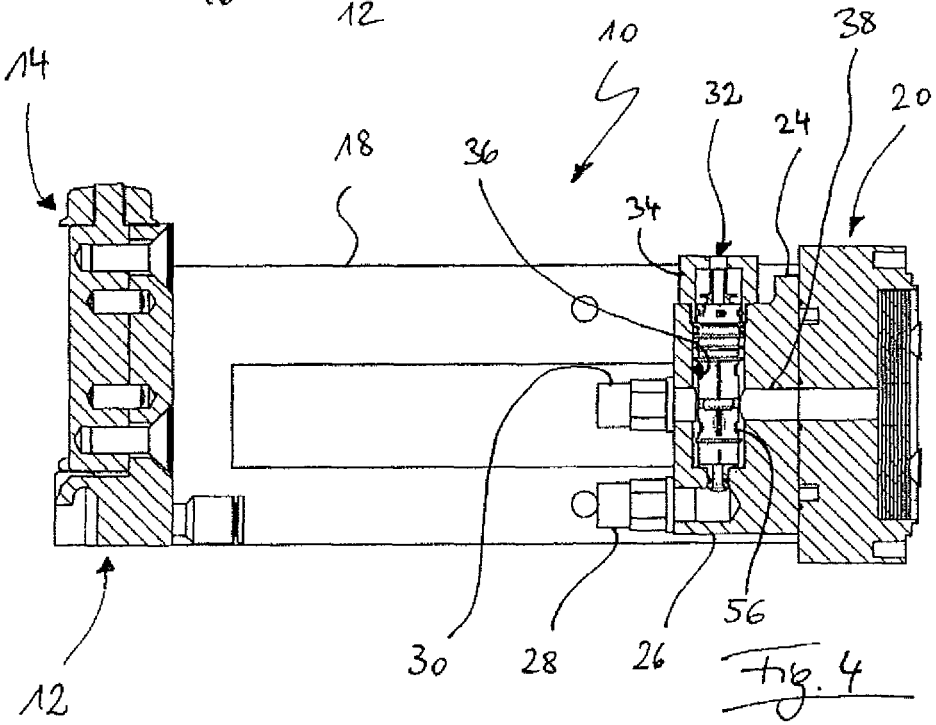

The present invention will be explained in the following purely by way of example with reference to advantageous embodiments and to the enclosed drawings. There are shown:

FIG. 1 a perspective view of a mechanical gripper;

FIG. 2 a perspective view of a gripper in accordance with an embodiment of the cutting apparatus in accordance with the invention;

FIG. 3 a detail view of the gripper head of the gripper of FIG. 2;

FIG. 4 a sectional view of the gripper head of FIGS. 2 and 3; and

FIGS. 5 to 9 further embodiments of the gripper in accordance with the invention or of a gripper head.

Figure 10:
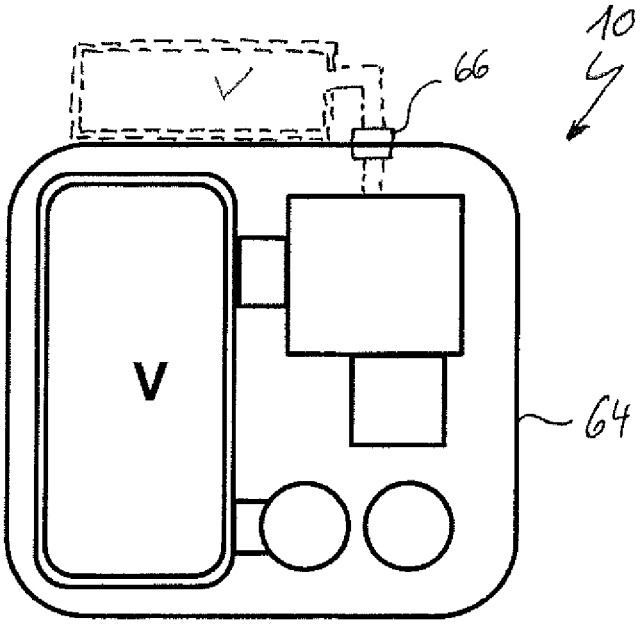
Figure 11:
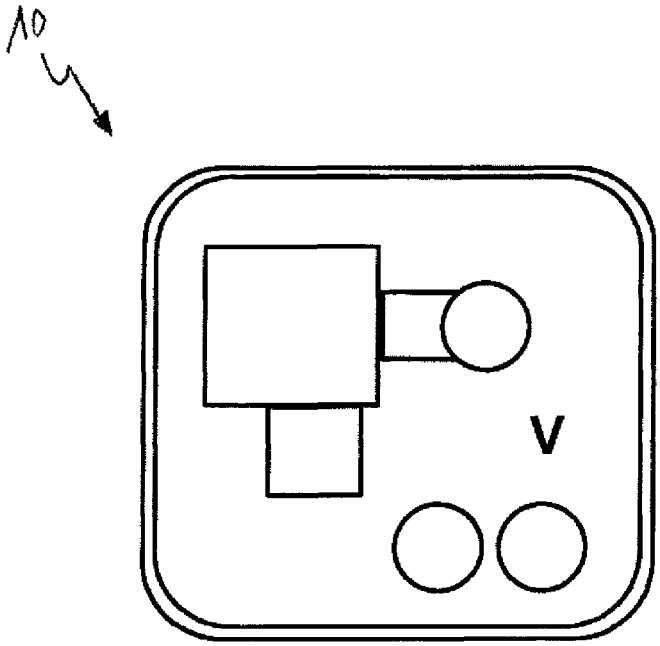

FIGS. 10 and 11 schematic cross-sections through a gripper head in accordance with the invention with different embodiments of a pressure reservoir.

FIG. 12 illustrates a cutting apparatus.

FIG. 1 shows a mechanical gripper GM that comprises a gripper base 11 and a gripper head 10M fastened thereto. Connections 50A, 50B are shown at the left end of the base 11 that enable a connection of the gripper G to an external pneumatic system (e.g. to the pneumatic system of a high performance slicer) and to other, pneumatically operated components (e.g. further grippers). The connections 50A serve for the compressed air supply; the connections 50B sere for the connection of parallel components (or vice versa). The supplied compressed air is thus "dragged through" by the gripper GM.

The gripper base 11 has a fastening section 11B that enables a simple fastening of the gripper GM to a corresponding holder, for example to a holder of a high performance slicer. In the present embodiment, the gripper base 11 is pushed onto a corresponding holding section.

The gripper base 11 has an interface 13 that is coupled to an interface 12 of the head 10M configured in a complementary manner. The interfaces 12, 13 each have a mechanical coupling section 14 and two pneumatic connections 16, which is shown by way of example using a vacuum gripper head 10 that is shown in FIGS. 2 and 3. The gripper head 10M has a likewise designed interface 12.

The standardized configuration of the interfaces 12, 13 enables a fast change of the head 10M. The gripper head 10M equipped with claws 10K engaging into the product and operated pneumatically can be replaced with a different gripper head, for example with a gripper head 10 such as is shown in FIG. 2. with a few movements. The gripper GM thus becomes a gripper G having different properties (the base 10 is not changed in this process). The head 10 is namely a vacuum gripper unit that gently sucks in the product and nevertheless holds it reliably without mechanically gripping deeply into it. The same pneumatic connections are used here that are also required for the operation of the gripper head 10M. If required, the compressed air supply can be converted (automatically or manually) such that sterilized compressed air is provided for the gripper G.

In other words, a modular system is provided by the releasable design of the heads 10, 10M that can be flexibly adapted to the respective conditions present. In a cutting apparatus having a plurality of grippers, a parallel use of mechanical grippers GM and vacuum grippers G is possible, i.e. any desired replacement of the grippers among one another or any desired use on adjacent tracks of a product supply of the cutting apparatus in accordance with the invention.

Since the same base 11 can be used for mechanical grippers heads 10M and vacuum gripper heads 10, the effort for the conversion is kept to a minimum. It is only necessary to "advise" a control unit of the gripper GM which head 10M, 10 is just being used. This can also be done automatically, for example by a corresponding mechanical coding at the respective head 10M, 10 that actuates a switch at the base 11 in a suitable manner. An electric coding and/or other means for identifying the gripper type and/or even the specifically used gripper (individual identification) can likewise be used.

FIGS. 3 and 4 show the gripper head 10 in more detail. The interface 12 is fastened to frame elements 18 (one not shown for reasons of clarity) at whose ends, that face the product to be held in operation of the gripper comprising the gripper head 10, a suction device 20 is arranged. An ejector device 22 is releasably fastened to the side of the suction device remote from the product. It comprises a fastening plate 24 at which an ejector block 26 is provided. The latter has a chamber 36 (see FIG. 4 with a sectional view of the head 10) that is in communication with a compressed air supply connection 28 (this is, for example, in communication with the right connection 16; the corresponding pressure line was not shown for reasons of clarity) and with an optional bypass connection 30 (see bypass 58 in FIGS. 6 and 8) (that is in communication with the left connection 16, for example). A nozzle device 56 is arranged in the chamber and the compressed air that is supplied through the connection 28 and that escapes from the chamber 36 through an outlet opening 32 flows through it in operation of the device 22. The outlet opening 32 is provided in a cover 34 that is screwed into an internal thread of the chamber 36. The nozzle device 56 is releasably connected or connectable to the cover 34 (e.g. by means of a screw connection or a snap-in connection) so that it can be simply removed together with the cover 34, for example for cleaning purposes.

With a closed bypass connection 30 and with a compressed air supply through the connection 28, air is sucked in at the side of the suction device 20 facing the product via at least one vacuum passage 38 connected to the chamber 36. If a product contacts the suction device 20 such that a sealing of a suction section of the device 20 that is as complete as possible is achieved with respect to the outside space (for example, by corresponding sealing lips contacting the product and/or by blades penetrating into the product), a vacuum is created that fixes the product at the device 20. The mode of operation of the pneumatic system will be described in even more detail in the following.

Figure 5:
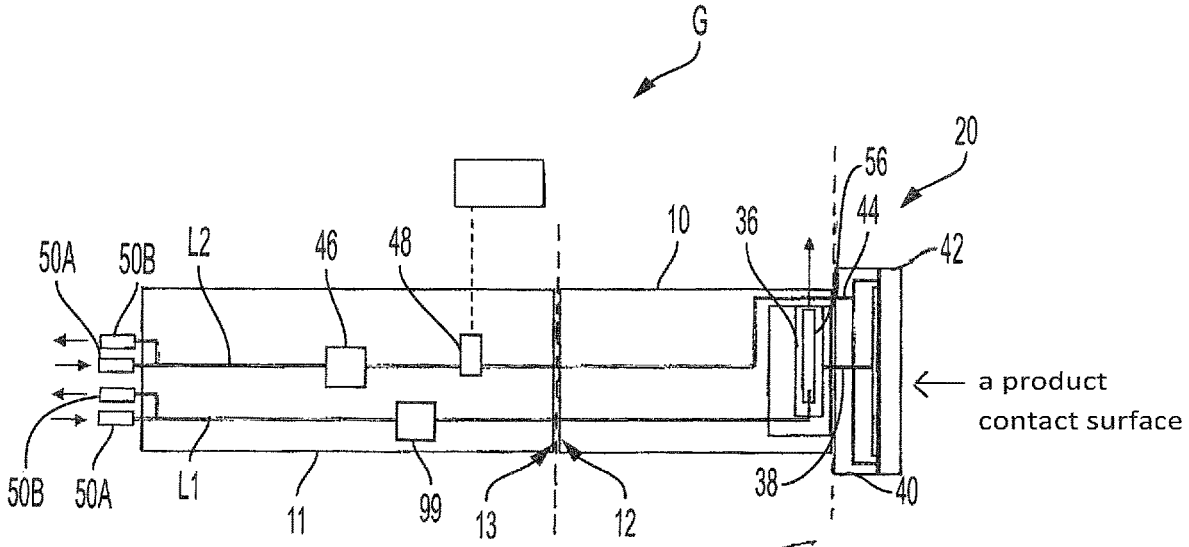

FIG. 5 schematically shows an embodiment of a gripper G in accordance with the invention. The latter in turn comprises the gripper base 11 having an interface 13 that is configured as complementary with the interface 12 of the gripper head 10 with respect to the mechanical and pneumatic coupling. The gripper G has a first pressure line L1 and a second pressure line L2 that—as already described—are each separable at the interfaces 12, 13. The pressure lines L1, L2 are in communication with an external pneumatic system, for example with a pneumatic system of a high performance slicer that comprises at least one compressed air source, not shown. The separating plane between the base 11 and the head 10 is indicated by a dashed line.

The interfaces 12 13 enable a fast change of the gripper head 10, whether for servicing purposes or to install a gripper head 10 optimized for the respective product provided. Since the interface 13 comprises a standardized mechanical coupling and the typically used pneumatic connections such as are also used with mechanical grippers that are pneumatically operated, the gripper G can be converted fast and without problem if it is required or desired.

The line L 1 is in communication with the chamber 36 of the ejector device 22 in which the nozzle device 56 is arranged. The cover 34 (partly) closing the chamber 36 (cf. FIG. 1) is not shown. In operation of the device 22, the line L 1 delivers 20 compressed air that is used by the device 22 to generate a vacuum. To be able to vary the generated vacuum, a pressure regulator 99 can be provided with which the compressed air supplied to the ejector device 22 can be provided in accordance with requirements. The regulator can be arranged outside the gripper G or in its base 11 or in the gripper head 10.

In operation of the ejector device 22, the nozzle device 56 is flowed through by compressed air from the line L1, whereby a vacuum is generated in the chamber 36 in a known manner in accordance with the principle of a jet pump. The compressed air leaving the chamber 36 is indicated by an arrow. The cover 34 that closes the chamber 36 and that has the outlet opening 32 is not shown.

The ejector device 22 is in communication with a suction unit 42 via at least the vacuum passage 38 that is formed in a distributor block 40. The distributor block 40 and the suction unit 42 together form the suction device 20.

The distributor block 40 to which the device 22 is, for example, releasably fastened serves to "distribute" the vacuum generated. The passage 38 shown by way of example can branch off for this purpose and can "transfer" the vacuum to the suction unit 42 at a plurality of points. In other words, it is possible to provide a plurality of suction openings at the suction unit 42 such that a more homogeneous sucking in of the product is made possible. For this purpose, suitable recesses and/or grooves that are in communication with the suction openings and that are set back with respect to a product contact surface against which the product is pressed during sucking in can also be provided at the side of the suction unit 42 facing the product. The most varied sealing devices can be provided to achieve a sealing with respect to the outside space. They in particular surround a region in which the suction openings, recesses and/or grooves are provided (suction section). A single suction section can be provided that is sealed with respect to the outer space; a plurality of mutually separate suction sections are, however, likewise conceivable.

To achieve a simple and fast adaptation of the gripper head 10 to the respective product to be gripped, the suction unit 42 in the present embodiment is releasably fastened to the distributor block 40. It can therefore be changed quickly as required. The distributor block 40 thus acts as a standardized "adapter" between the ejector device 22 and the suction unit 42. The distributor block 40 is likewise releasably connected to the further components of the head 10 to be able to be replaced quickly as required (see the separation plane indicated by the dashed line).

While the line L1 serves for the generation of a vacuum, the line L2 delivers compressed air to the suction unit 42 as required via at least one pressure passage 44, preferably a plurality of pressure passages 44, in the distributor block 40 (corresponding passages in the unit 42 are not shown). It is understood that the passage/passages 44 is/are not in communication with the at least one vacuum passage 38. This compressed air is used to actively release the sucked in product from the suction unit 42 and thus, for example, to eject an end piece of the product. Corresponding ejection nozzles of the suction unit 42 that can be acted on by compressed air are preferably provided in a marginal region of the suction section of the suction unit 42 (not shown).

A stop valve 46 arranged in the line L2 acted on by compressed air is opened to eject the product. Compressed air thereby moves via the line(s) 44 to the ejection nozzles of the suction unit 42, whereby the product is expelled. The compressed air supply via the line L1 is preferably interrupted in this process.

The stop valve 46 can in particular be configured such that it is automatically opened by the pressure present in the line L2. If the pressure in the line L2 exceeds a predefined threshold value, the valve 46 opens to actively eject the product by means of compressed air. The above-described configuration of the stop valve 46 is simple and robust in construction and makes separate control lines unnecessary.

The pressure present in the pressure line L2 can be monitored by means of a pressure sensor 48 that is connected to a control device 54. With a closed stop valve 46, the vacuum applied to the product can also be monitored.

Figure 6:
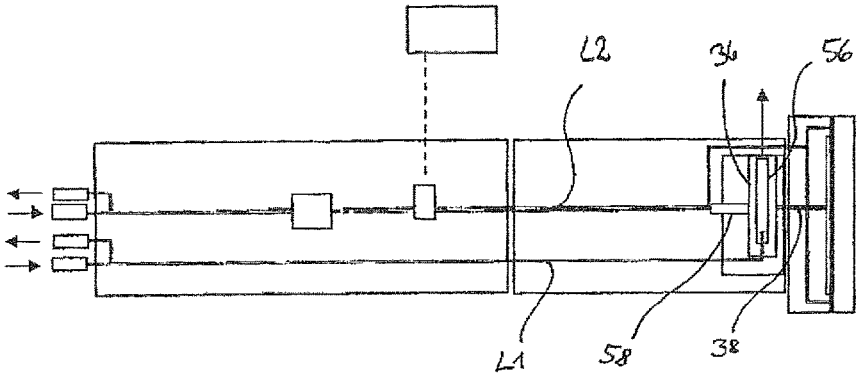

FIG. 6 shows an alternative embodiment of the pneumatic system provided for the operation of the gripper G. It is in principle based on that of FIG. 5. Here, however, the chamber 36 is in communication with the line L2 via a bypass line 58. As soon as the line L2 conducts compressed air, this compressed air is also supplied to the chamber 36. The ejection is thus also amplified via the vacuum passage 38. Alternatively to the embodiment shown, the bypass can also be provided in the distributor block 40. There is then a connection between the passages 38 and 44. This modification is also possible in the embodiment shown in FIG. 8.

Figure 7:
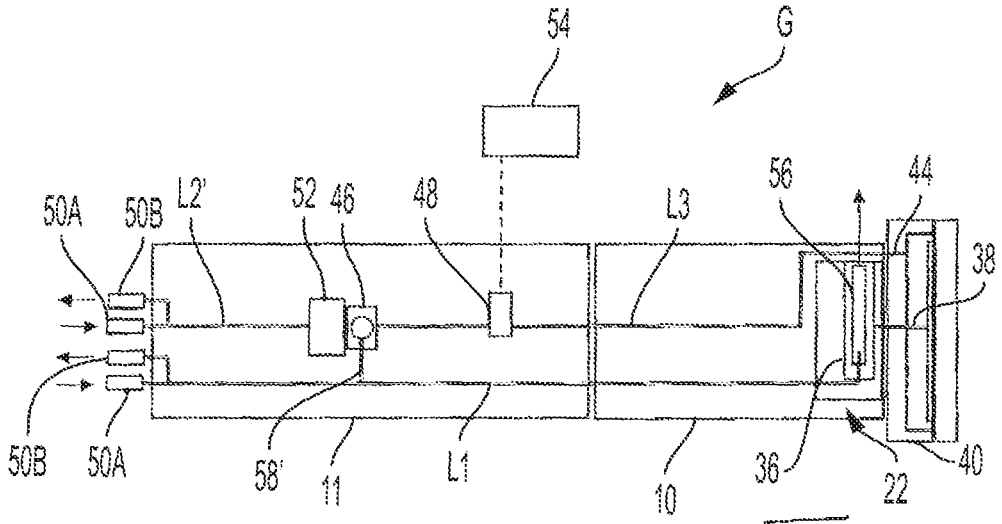

FIG. 7 shows a further alternative embodiment of the pneumatic system provided for the operation of the gripper G. The gripper G in accordance with FIG. 7 likewise comprises a stop valve 46 in its base 11 that is, however, in communication with the pressure line L1 (bypass line 58'). The stop valve 46 can be closed or opened via a switching device 52. A switching pulse or a control pressure required for this is provided via the pressure line L2'. The valve 46 can generally also be electrically controlled.

With an open valve 46, a compressed air line L3 is connected to the pressure line L1. The pressure passage 44 is thereby acted on by compressed air, which results in an ejection of the sucked in product. The pressure present in the line L3 is in turn monitored by means of the pressure sensor 48. With a closed valve 46, the vacuum acting on the product and/or an effective closing of the ejection nozzles, which can be assessed as a sign of an effective holding of the product, can in turn be monitored (this applies to all the embodiments shown). The pressure sensor 48 is connected to the control device 54 that can also be used for the regulation as required of the pressure in the line L1 and for the generation of a control pressure in the line L2' (this also applies to all the embodiments shown).

For reasons of completeness, it is again pointed out that the passages 44 and 38 in the distributor block 40 do not communicate with one another.

Figure 8:
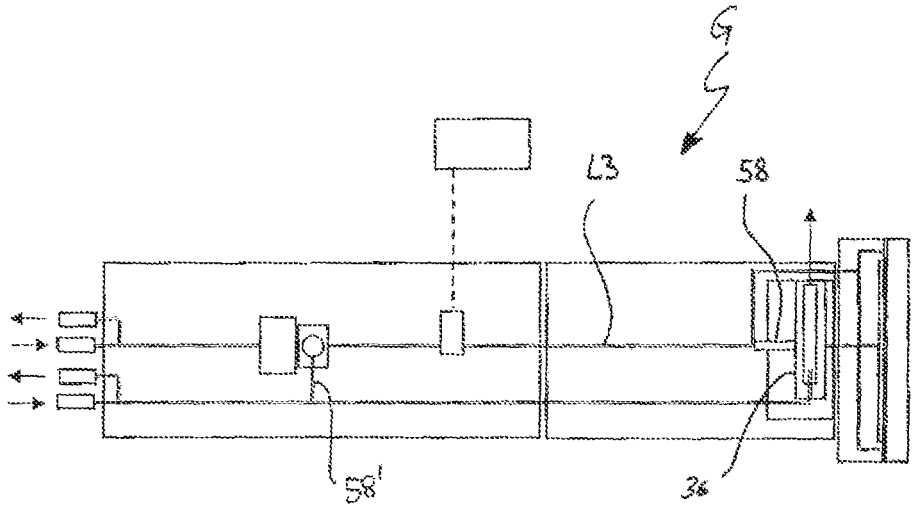
Figure 9:
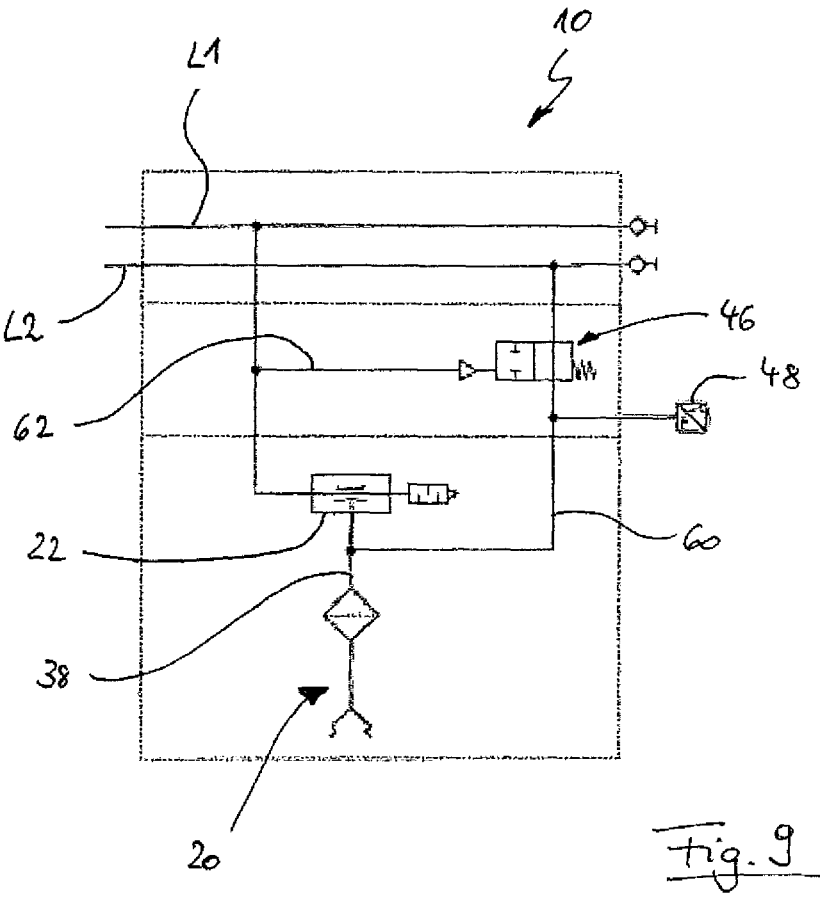

FIG. 8 shows a somewhat modified embodiment that is based on FIG. 7. As in the embodiment in accordance with FIG. 6, the chamber 36 is here in communication with the line L3 via the bypass line L3. As soon as the line L3 conducts compressed air, this compressed air is also supplied to the chamber 36. The vacuum generation in the device 22 is thereby practically suppressed, even though compressed air still flows through the nozzle device 56. A bypass can also be established by a connection of the lines 44 and 38, A further embodiment of the pneumatic system provided for the operation of the gripper G can be seen in FIG. 9. The part of the system provided in the gripper head 10 is shown. It in turn comprises the ejector device 22 that is connected to the line L1. In addition, the device 22 is in communication with the suction device 20 via the vacuum line 38. The line L2 is in contract with a connection line 60 that can be selectively blocked with the aid of the stop valve 46. The stop valve 46 is controllable in dependence on the pressure present in the line L1 (e.g. via a control line 62). The valve 46 is, for example, securely closed by the pressure present in the line L1 so that the line 60 is separated from the line L2. This corresponds to suction operation. The pressure sensor 48 then measures the vacuum present in the suction device 20. As soon as pressure is applied for ejection in the line L2 and there is no longer any pressure in the line L1 (or as soon as a certain pressure threshold is fallen below there), the valve 47 opens by means of a spring integrated there and the compressed air applied in the line L2 leads to an active ejection of the product from the suction device 20.

It is generally not necessary that the valve 46 or a switching device associated with it is connected to the line L1. Provision can also be made that the valve 46 is controlled by a control device 54 that is, for example, also connected to the sensor 48.

FIGS. 10 and 11 show cross-sections through a gripper head 10 with different embodiments of a pressure reservoir V.

As has initially been described, improved operating dynamics can be achieved by the spatial proximity of the pressure reservoir V serving as a pressure source—or at least assisting an external pressure source—to the consumers (e.g. ejector device 22 and/or expulsion devices). FIG. 10 shows an embodiment in which the reservoir V is integrated into a housing 64 of the head 10. A variant is indicated by dashed lines in which the reservoir V is installed at the head 10. It is understood that the reservoir V is connected to the further components—only schematically indicated in FIGS. 10 and 11—of the pneumatic system of the head 10. An interface or a suitable connector 66 is provided for this purpose in the dashed variant.

The reservoir content in the corresponding embodiment is, for example, released by means of a switch valve as soon as the line L1 is pressureless.

In the embodiment in accordance with FIG. 11, the reservoir V is likewise integrated in the head 10. The reservoir V here itself forms at least a part or a section of the housing of the head 10 so that the above-named components—or at least some of them—are received by the reservoir V. This variant is particularly space-saving and also protects said components.

In both cases, the reservoir V can be a suitable hollow profile that is closed by covers at its front sides.

If two or more grippers G are provided in an apparatus, in particular in an apparatus for cutting a product, they can also be connected individually and in particular directly to the pneumatic system (a grouping of grippers for the purpose of a group-wise compressed air supply is also conceivable) to simplify a selective control of the grippers GM. For example, a time-displaced ejection or expulsion of the products (see below), for example displaced by a few milliseconds, can be realized. With a separate connection of the grippers G, it can additionally be ensured that the expulsion/ejection pulse is of an equal amount everywhere. A pressure drop in the compressed air supply of one of the grippers—for instance, on an expulsion pulse—then has no effect or only a small effect on the pressure level in the compressed air supply of the other grippers. The same applies analogously to the vacuum generation in the gripper head.

It is generally also conceivable that a provision and/or generation of vacuum for operating the suction device takes/take place by a pneumatic system that is separate from a system that serves for the provision of an expulsion pulse or ejection pulse.

It must be mentioned for reasons of completeness that the expulsion or ejection of the product does not only have to take place by a pressure pulse acting directly on the product. Provision can also be made to effect the expulsion or ejection by elements actuated by compressed air or in a different manner, e.g. small plungers.

A gripper in accordance with the present invention can—as already stated—be used in an apparatus for cutting a product, in particular in a high performance slicer. Such high performance slicers frequently comprise a plurality of grippers with which a plurality of products can be held and can thus be sliced simultaneously. It is by all means possible to use grippers of different types next to one another in such a slicer gripper.

The measure in accordance with the invention of giving the gripper a modular design, namely of releasably coupling the gripper head to a base connected to the cutting apparatus, makes it possible to convert conventional high performance slicers in a simple manner. If the vacuum gripper head's "own" vacuum generation device is integrated in it, use can also be made of the compressed air connections also provided as a rule for mechanical gripper heads.

A reliable gripping of a product by means of vacuum generally makes a mechanical penetration into the product superfluous so that end pieces occurring on the slicing of the product are comparatively smaller. Substantial cost advantages accompany the minimization of the product waste.

The modular design of the gripper in accordance with the invention also simplifies its cleaning and maintenance.

A change between a vacuum gripper head and a mechanical gripper head—and vice versa—can also take place, in the simplest case, without any real interventions or with only comparatively small interventions in a higher ranking control.

The suction function of the vacuum gripper head makes it possible to hold the product to be gripped more gently than typical mechanical grippers. The gripping process per se is also more gentle since the vacuum gripping head can be led with an already working suction device in a controlled manner toward the product end. It is namely recognized very quickly by the monitoring of the vacuum by means of the pressure sensor as soon as the gripping head securely contacts the product. The measured pressure namely then drops rapidly. In contrast to this, the product is compressed on a mechanical gripping to ensure a secure penetration of the claws or needles.

The monitoring of the vacuum does not only serve the recognition of a successful gripping of the product, but rather also serves for process security. If namely the measured pressure increases during the holding of the product, this can be an indication of leaks that can result in a reduction of the holding force. Such leaks can, for example, occur due to a wear of the sealing devices. Provision can be made to compare the measured pressure value with a stored reference value and to output an error message and/or a warning signal when it is exceeded/fallen below. The reference value is, for example, determined on the putting into operation of the apparatus and/or after a change of the gripper head under defined conditions. It can also be product dependent and/or load dependent. A determination of the reference value can also take place during special, suitable phases during operation. A plurality of "sampling points" are, for example, recorded, evaluated, and compared. Additionally or alternatively test measurements and/or reference measurements can be carried out with a reliably closed suction section or with reliably closed suction openings (for example using a suitable closure cap/cover).

To check whether the ejection of the product, for example, by a compressed air impulse, was successful, provision can be made to again briefly activate the suction function of the gripper head and to check whether a vacuum is generated in the suction section. If this is the case, this is an indication that the product has not yet been (completely) ejected. The above-described process can be repeated once or a plurality of times as required.

REFERENCE NUMERAL LIST

10, 10M gripper head
10K claw
11 gripper base
12, 13 interface
14 mechanical coupling section
16 pneumatic connection
18 frame element
20 suction device
22 ejector device
24 fastening plate
26 ejector block
28 compressed air supply connection
30 bypass connection
32 outlet opening
34 cover
36 chamber
38 vacuum passage
40 distributor block
42 suction unit
44 pressure passage
46 stop valve
48 pressure sensor
50A, 50B connection
52 switching device
54 control device
56 nozzle device
58, 58' bypass line
60 connection line
62 control line
64 housing
66 reservoir connector
L1, L2, L2', L3 pressure line
G, GM gripper
V pressure reservoir

The invention claimed is:

1.

A cutting apparatus for cutting food products comprising:

a blade for cutting a food product, a gripper for gripping the food product, the gripper having a gripper base and a gripper head fastened to the gripper base, wherein the gripper head comprises at least one suction device that can be acted on by vacuum and that can be brought into contact with an end section, of the product to suck it in, with the gripper head being releasably fastened to the gripper base;

a vacuum generation device for generating the vacuum is arranged in or at the gripper head, wherein the vacuum generation device comprises a jet pump, the jet pump comprising an ejector;

wherein an interface that comprises at least one coupling section for fastening the gripper head to the gripper base and at least one drive coupling section for transferring an operating medium and/or drive energy to operate the at least one suction device is provided at the gripper head and at the gripper base to couple the gripper head and the gripper base, wherein the at least one drive coupling section comprises at least two pneumatic coupling sections, wherein the gripper head comprises the at least one a suction device being in communication with the vacuum generation device, the at least one suction device comprising a distributor block and a suction unit that is provided with a product contact surface, wherein the distributor block is releasably connected to the at least one suction device and/or the suction unit, and wherein the vacuum generation device has a chamber which is in communication with the at least one suction device via a vacuum line and in which a nozzle device is arranged that can be flowed through by compressed air in operation of the vacuum generation device.

2.

A The cutting apparatus in accordance with claim 1, wherein the chamber has an outlet opening that is formed in a releasable closure element.

3. The cutting apparatus in accordance with claim 2, further comprising a first pressure line (LI) that is connected to the vacuum generation device and that has a pressure regulator;

a second pressure line (L2) connected to the suction unit of the suction device, wherein the second pressure line (L2) and the chamber of the vacuum generation device are pneumatically connected via a bypass connection.

4. the cutting apparatus in accordance with claim 3, wherein a pressure sensor is associated with the second pressure line (L2), wherein the second pressure line (L2) comprises a stop valve, wherein at least one of the pressure regulator, the pressure sensor and the stop valve are arranged in or at the gripper base.

* * * * *